US005937505A

United States Patent [19]

Strong et al.

[11] Patent Number: 5,937,505

[45] **Date of Patent: *Aug. 17, 1999**

[54] METHOD OF EVALUATING A CRIMPED ELECTRICAL CONNECTION

[75] Inventors: Michael D. Strong, Mechanicsburg; Michael A. Yeomans, Camp Hill, both of Pa.

[73] Assignee: The Whitaker Corporation, Wilmington, Del.

[ * ] Notice: This patent is subject to a terminal disclaimer.

[21] Appl. No.: 08/397,459

[22] Filed: Mar. 2, 1995

[51] Int. Cl.[6] ..... H01R 43/048; B21C 51/00

[52] U.S. Cl. ..... 29/593; 29/705; 72/21.4

[58] Field of Search ..... 29/593, 863, 715, 29/705, 753; 72/20.1, 416, 21.4

[56] References Cited

U.S. PATENT DOCUMENTS

| | | | |
|---|---|---|---|
| 4,856,186 | 8/1989 | Yeomans | 29/863 |
| 4,914,602 | 4/1990 | Abe et al. | 364/507 |
| 4,916,810 | 4/1990 | Yeomans | 29/863 |
| 5,084,960 | 2/1992 | Yeomans | 29/753 |
| 5,092,026 | 3/1992 | Klemmer | 29/593 |
| 5,101,651 | 4/1992 | Yeomans | 72/19 |
| 5,123,165 | 6/1992 | Strong et al. | 29/861 |
| 5,168,736 | 12/1992 | Enneper | 29/715 |
| 5,197,186 | 3/1993 | Strong et al. | 29/863 |
| 5,271,254 | 12/1993 | Gloe | 29/715 |
| 5,337,589 | 8/1994 | Gloe et al. | 72/11 |
| 5,491,994 | 2/1996 | Baldyga | 29/705 |

FOREIGN PATENT DOCUMENTS 0 460 441 A1 12/1991 European Pat. Off. ..... H01R 43/048

OTHER PUBLICATIONS

European Search Report, Date of Completion, May 22, 1997, Application No. EP 96 30 0747.

*Primary Examiner*—Daniel C. Crane
*Attorney, Agent, or Firm*—Bradley N. Ditty

[57] ABSTRACT

Apparatus and method for evaluating a crimped electrical connection measures the crimping force over a range of positions of the crimping apparatus ram and derives a statistical envelope of acceptable forces. Each crimp is measured and the force measurements are compared against that envelope to determine the acceptability of the crimp. Acceptable crimps are then further evaluated to determine whether their data should be added to the data base.

10 Claims, 5 Drawing Sheets

METHOD OF EVALUATING A CRIMPED ELECTRICAL CONNECTION

BACKGROUND OF THE INVENTION

This invention relates to the termination of terminals to respective wires and to the controlling of the quality of such terminations.

Electrical terminals are typically crimped onto wires by means of a conventional crimping press having a die set with a first part mounted to a base for supporting the electrical terminal and a second part mounted to a ram that is movable toward and away from the base for effecting the crimp. In operation, a terminal is placed on the first part of the die set, an end of a wire is inserted into the ferrule or barrel of the terminal, and the ram is caused to move toward the base to the limit of the stroke of the press, thereby crimping the terminal onto the wire. The ram is then retracted to its starting point.

In order to obtain a satisfactory crimped connection, the crimp height and other characteristics of the crimped terminal must be closely controlled. The crimp height of a terminal is a measure of height or maximum vertical dimension of a given portion of the terminal after crimping. Ordinarily, if a terminal is not crimped to the correct crimp height for the particular terminal and wire combination, an unsatisfactory crimped connection will result. On the other hand, many unsatisfactorily crimped connections will, nevertheless, exhibit a "correct" crimp height. A crimp height variance or other physical variation in the crimped terminal is not in and of itself the cause of a defective crimp connection, but rather, may be indicative of another factor which causes the poor connection. Such factors include using the wrong terminal or wire size, missing strands of wire, wrong wire type, and incorrect stripping of insulation. Since such defective crimped connections frequently have the appearance of high quality crimped connections, it is difficult to identify these defects in order that timely corrective action may be taken.

A simple non-destructive means of detecting such defective crimped connections by accurately measuring crimp height during the crimping process is disclosed in U.S. Pat. No. 4,856,186 which issued Aug. 15, 1989, to Yeomans and U.S. Pat. No. 4,916,810 which issued Apr. 17, 1990, to Yeomans, both of which are incorporated by reference as though fully set forth herein.

What is needed is an apparatus and method of use thereof which, utilizing the teachings of the above referenced patents, detects a defectively crimped terminal by analyzing the crimping forces imposed on the terminal during the actual crimping operation. One such apparatus and method is disclosed in U.S. Pat. No. 5,197,186 to Strong et al, the contents of which are incorporated by reference herein. This patent discloses the collection of force and displacement data during a crimping cycle and comparing that data with data in a data base. Such comparison is utilized to determine whether a particular crimp meets acceptable standards.

It is an object of the present invention to provide a method of evaluating a crimped electrical connection which has greater sensitivity than the method disclosed in the aforereferenced Strong et al '186 patent.

It is another object of this invention to provide such a method wherein there are fewer rejections of acceptable crimps.

It is a further object of this invention to provide such a method which is adaptive to a variety of crimping conditions.

SUMMARY OF THE INVENTION

The foregoing and additional objects are attained in accordance with the principles of this invention by providing a method of evaluating the quality of the crimp of an electrical terminal crimped onto a wire by crimping apparatus which includes a press having a base and a ram arranged for opposing relative reciprocation. The base and the ram each carry a mating half of a crimping die set. A terminal and a wire are first placed into a crimping position within the crimping apparatus and then at least one of the base and the ram is caused to undergo reciprocation so that the die set engages the terminal, crimps the terminal onto the wire, and disengages from the terminal. During the crimping step, a series of paired measurements are taken of the distance between the terminal engaging portions of the die set and the force applied to the terminal by the die set. A data base is provided which contains upper and lower force values for a set of predetermined distances so as to define a band (envelope) of force measurements within which lie the force measurements of an acceptable crimp. The series of paired measurements taken during the crimping operation are evaluated with respect to the defined band, and a crimp is rejected if a predetermined number of its series of paired measurements fall outside the defined band. In accordance with an aspect of this invention, the predetermined number for rejection is equal to one.

In accordance with another aspect of this invention, the series of paired measurements are taken at a plurality of equally spaced time intervals.

In accordance with yet another aspect of this invention, the data base is generated by taking a series of paired measurements from a sample set of a plurality of acceptable crimps.

In accordance with a further aspect of this invention, the defined band of acceptable force measurements is calculated by interpolating the series of force measurements for each of the plurality of acceptable crimps to obtain a plurality of acceptable forces at each of the predetermined distances and calculating an average acceptable force at each of the predetermined distances from the plurality of acceptable forces. There is then calculated a standard deviation at each of the predetermined distances from the plurality of acceptable forces and the upper and lower force values are defined for each of the predetermined distances by adding and subtracting, respectively, a first number of standard deviations to the average acceptable force for that predetermined distance.

In accordance with still a further aspect of this invention, the data base is modified by including measurements taken on later acceptable crimps.

In accordance with yet a further aspect of this invention, only those acceptable crimp measurements are added to the data base which fall within a narrow band within the defined band for acceptable crimps.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
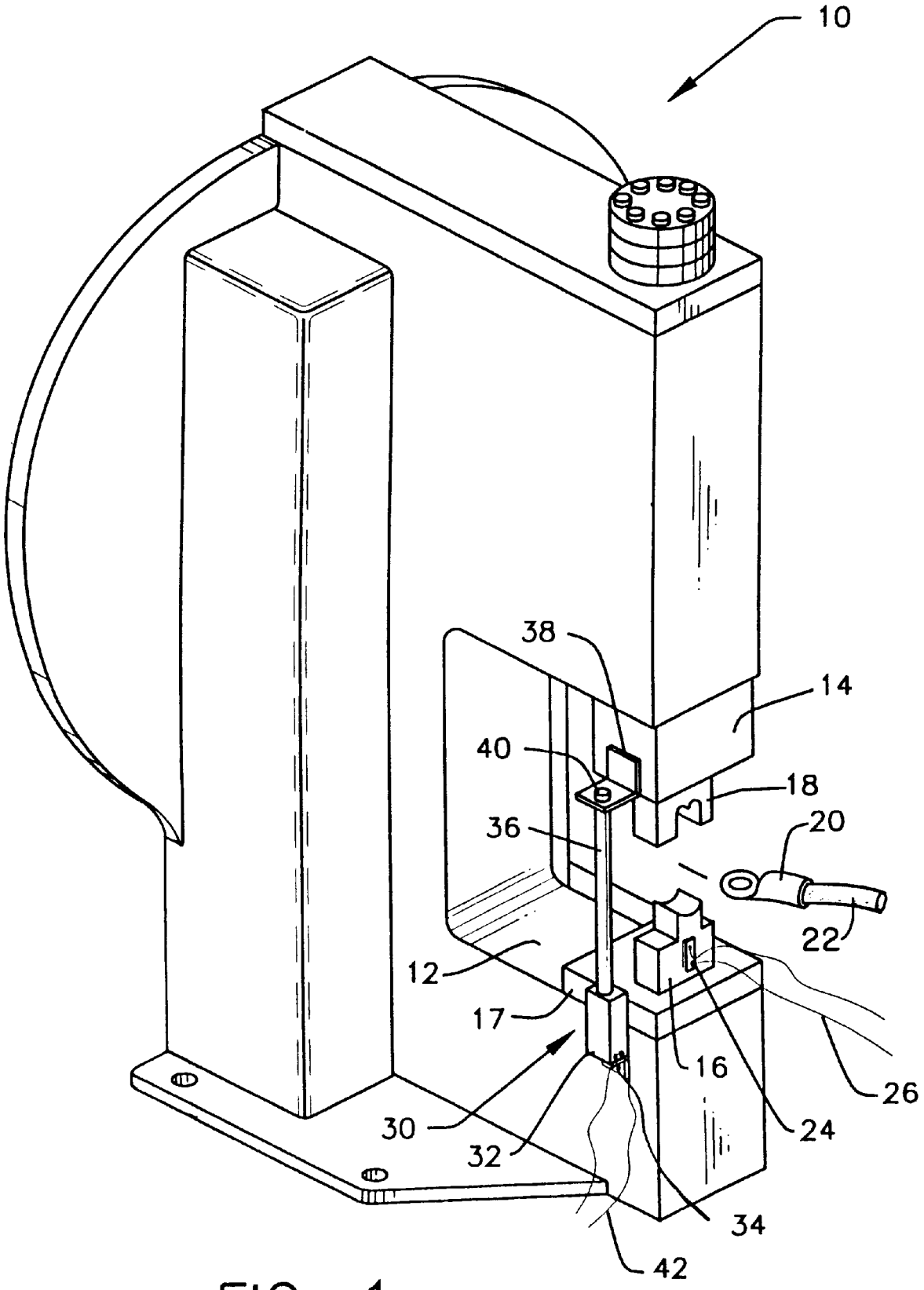
FIG. 1 is a perspective view of a crimping apparatus incorporating the teachings of the present invention.

There is shown in FIG. 1 a crimping press 10 having a base 12 and a ram 14 arranged for reciprocating opposed motion relative to the base 12. The crimping press 10, in the present example, is of the type having a flywheel and clutch arrangement for imparting the reciprocating motion to the ram 14; however, other types of presses having a suitable ram stroke may be used in the practice of the present invention.

The base 12 and the ram 14 each carry a mating half of a crimping die set in the usual manner. The die set includes an anvil 16 which is removably attached to a base plate 17 and a punch 18 which is removably attached to the ram 14, as shown in FIG. 1. The base plate 17 is coupled to the base 12 in a manner that will permit vertical movement of the plate 17. A typical terminal 20 is shown in FIG. 1, crimped onto a wire 22.

As shown in FIG. 1, a strain gage 24 is attached to the anvil 16 in the usual manner by epoxy or soldering. A pair of leads 26 carry a signal that is proportional to the stress placed on the anvil 16 which is transferred to the anvil 16 from the ram 14 and through the terminal 20 and wire 22 being crimped. The signal appearing on the leads 26 is indicative of the force imposed upon the terminal 20 during crimping, as set forth in more detail in the aforereferenced Yeomans '186 patent.

A linear distance sensor 30 is arranged to measure the displacement of the ram 14 with respect to the base 12. The sensor 30 includes a stator 32, which is rigidly attached to the base 12 by a suitable bracket 34, and an armature (not shown) which is movable within the stator 32 in the vertical direction as viewed in FIG. 1. A push rod 36 projects upwardly from the stator 32 and has one end attached to the movable armature and the other end adjustably attached to the ram 14 by means of a suitable bracket 38 and adjusting nut 40. A pair of leads 42 carry a signal that is proportional to the vertical position of the armature within the stator 32. This signal is indicative of the vertical distance between the anvil 16 and the punch 18 as set forth in more detail in the '186 patent. As explained therein, by monitoring the signals on the leads 26 and 42, the actual crimp height of the crimped terminal 20 can be accurately determined. It will be understood that the signal on the lead 42 is also indicative of the amount of deformation of the terminal being crimped by the anvil 16 and the punch 18. Additionally, other parameters may be determined as well, such as the peak force exerted on the terminal 20 and the amount of work performed to complete the crimp.

The method and apparatus for measuring force and ram displacement and generating the respective signals on the leads 26 and 42, as described above, is by way of example only. Any suitable devices that are well known in the art may be utilized for these functions. For example, in place of the sensor 30, permanent magnets may be associated with the ram and a Hall effect device may be attached to the base and arranged to sense the relative position of the magnets. Other suitable devices for sensing and signaling force and ram displacement will occur to those skilled in the art and may advantageously be applied to practice the teachings of the present invention.

Figure 2:
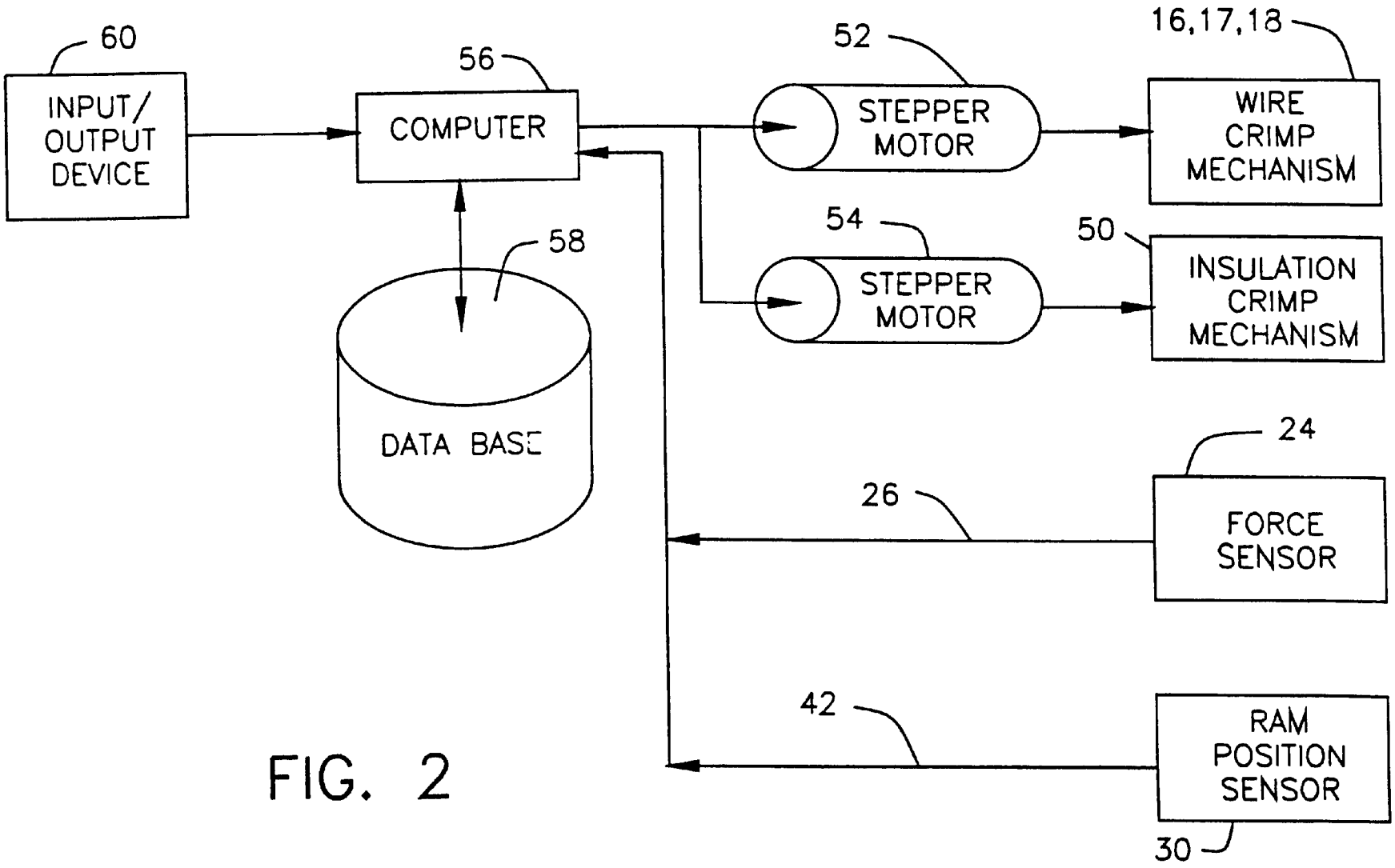
FIG. 2 is a block diagram showing typical functional elements employed in the present invention.

The major functions of the machine are shown in FIG. 2. Note that the wire crimping mechanism is identified as 16, 18 and 17 which represent the anvil, punch, and movable base plate respectively, and the force and ram position sensors are identified as 24 and 30 which represent the strain gage and linear distance sensor, respectively. An insulation crimping mechanism 50 is depicted in FIG. 2 as an example of other instrumentalities that may be controlled in a manner similar to that of the wire crimping mechanism. Other similar instrumentalities may also be controlled in a similar way. The actual adjusting means which physically moves or adjusts the base plate 17, in the case of the wire crimp mechanism, or another adjustable device in the case of the insulation crimp mechanism, are driven by stepper motors 52 and 54, respectively. Any suitable actuator which can be driven through a computer input/output channel may be substituted for the stepper motors 52 and 54. A computer 56, having a storage device 58 associated therewith for storing a data base and an input/output device 60 for operator communication, is arranged to drive the stepper motors 52 and 54. This is done in response to operator input through the device 60 and input from either the force sensor 24 or the ram position sensor 30.

The signal appearing on the leads 26, which is indicative of the force imposed upon the terminal 20, and the signal appearing on the leads 42, which is indicative of the relative position of the mating halves of the crimping die set 16, 18, are monitored by the computer 56 and recorded on the storage device 58 in a manner that is well known in the art. These signals are recorded as pairs of data elements, one pair for each discrete increment of time during the crimping cycle. Illustratively, after the start of a crimp is detected, as for example, by detecting a predetermined change in the position signal on the leads 42, the signals on the leads 26 and 42 are sampled every two hundred microseconds during a one hundred millisecond interval. This provides a sample rate of five thousand samples per second, for a total of five hundred measurements per crimping cycle. The one hundred millisecond measuring interval is more than sufficient to cover an entire crimp cycle.

Figure 3:
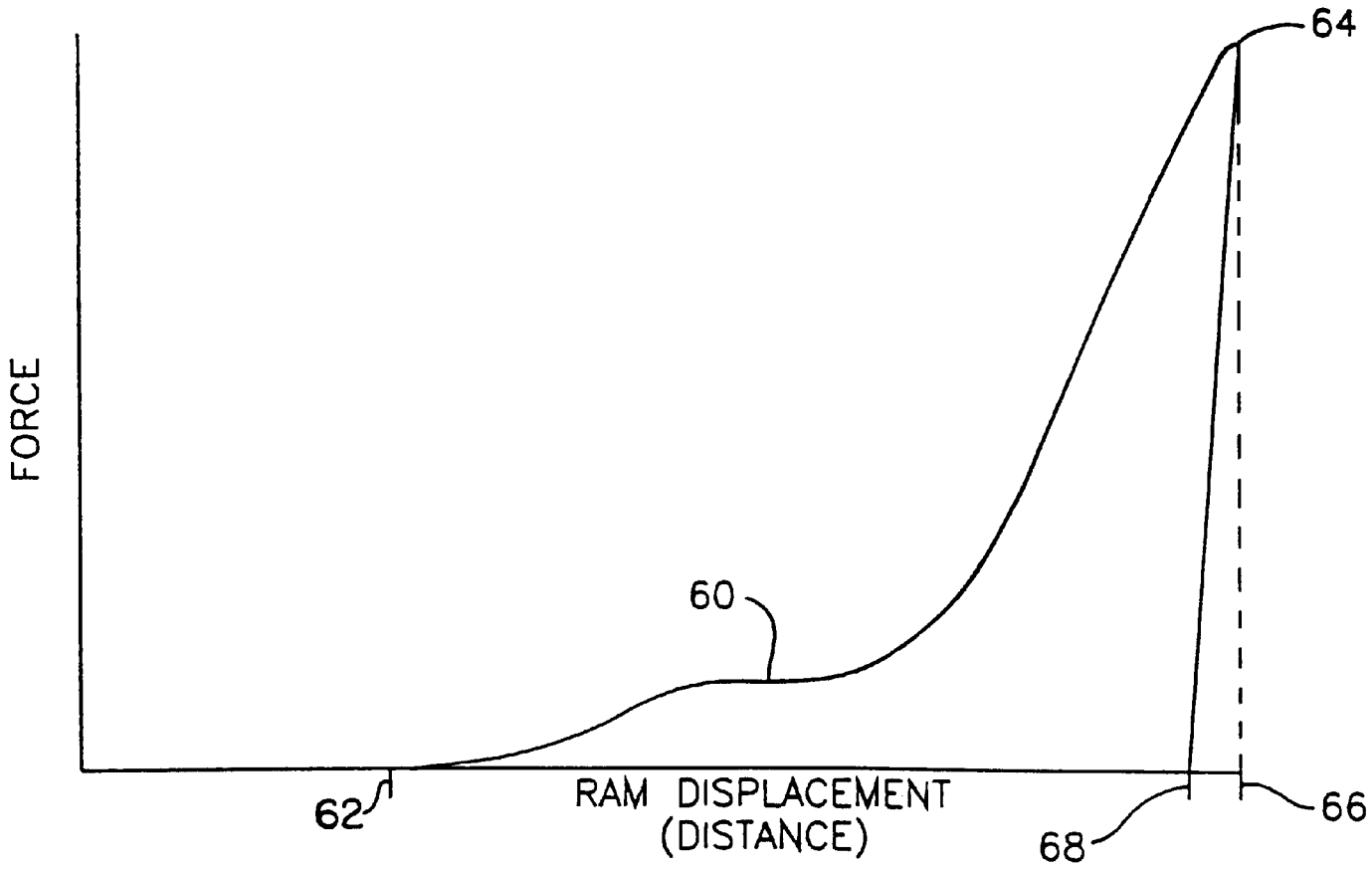
FIG. 3 shows a graph relating crimp force to ram displacement during the crimping of a terminal onto a wire.

FIG. 3 shows a graph 60 which depicts the relationship of crimp force on the terminal 20 with respect to displacement of the ram 14. As the ram 14 moves toward the base 12, it reaches a point where the terminal engaging surfaces of the die set 16, 18 are in light engagement with the terminal 20. This point is indicated at 62 along the horizontal axis of FIG. 3. As the ram 14 continues its movement, the force exerted on the terminal 20 increases, as shown by the graph 60, until a peak force 64 is reached, having a ram displacement indicated at 66. This is the point where the ram 14 is in its fully down position. At this point, the terminal 20 is under substantial compressive forces and, being an elastic body, will rebound some amount when the compressive forces are removed. As the ram 14 begins to recede upwardly away from the base 12, the force on the terminal 20 gradually reduces to zero. This occurs at the point along the horizontal axis indicated at 68. Precisely where this point 68 occurs along the horizontal axis can be translated to a separation between the die set halves 16, 18. This is done by sampling the signal present on the leads 42 and translating this signal into a distance. According to the present invention, the portion of the curve 60 that is significant is for forces which are in the range of approximately 40% above the minimum force at the point 62 through 5% below the maximum force at the point 64.

Figure 4:
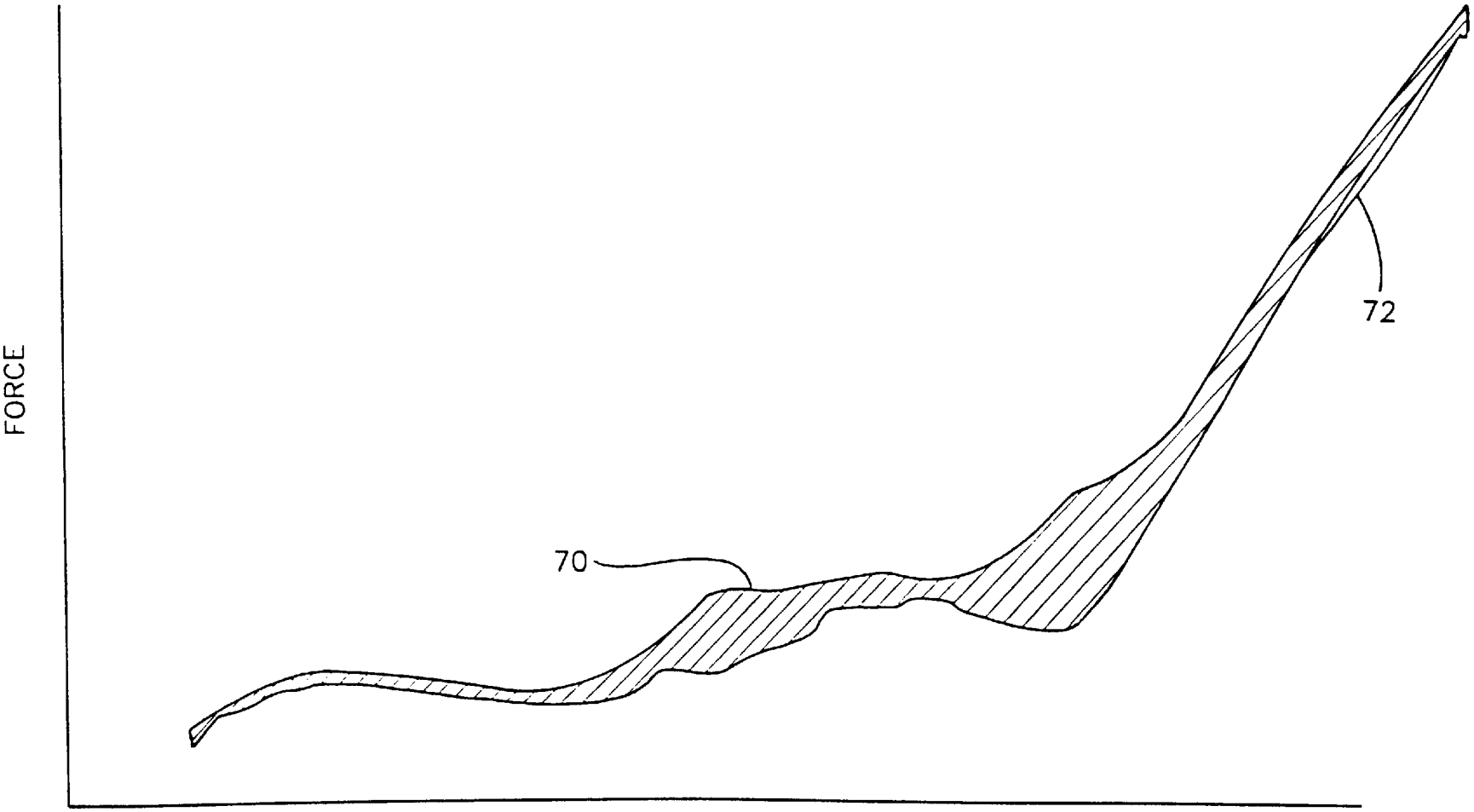
FIG. 4 shows an illustrative defined band for an acceptable crimp and also shows a measured crimp falling outside the defined band.

Initially, according to the present invention, data is collected from a plurality of acceptable sample crimps and statistical theory is utilized to develop a continuous envelope (band) of allowable variation in the curve 60. The width of the envelope is proportional to the normal variation expected in a given region. During a crimping operation, the data for that specific crimp is analyzed and compared with the band and, if the data for that crimp falls outside the band, the crimp is considered to be defective. FIG. 4 illustrates the desired band 70 taken from force and displacement measurements on acceptable crimps in the range of interest, as discussed above.

According to the present invention, within the range of interest, a fixed number of distances are chosen from the five hundred measurements. Thus, there may be anywhere from twenty to forty distances chosen to provide a set of predetermined distances within the range of interest. Since the measurements are taken at time intervals which may not correspond to those particular predetermined distances, the measurements are interpolated to derive force measurements at those distances. Initially, a calibration operation is performed wherein a predetermined number of terminal crimps (typically ten crimps) are visually inspected by an operator. After each crimp, the operator examines the crimped terminal and determines whether it is acceptable. If the crimp is acceptable, the operator so indicates to the computer 56 by means of the input/output device 60. The measurements for that crimp are then interpolated to arrive at a set of force measurements at the set of predetermined distances. After each acceptable crimp, the computer 56 calculates the average acceptable force value and the standard deviation at each interpolated distance within the set of predetermined distances. The defined band 70 (FIG. 4) is calculated as the average acceptable force at each of the interpolated distances plus/minus a predetermined number of standard deviations of the average acceptable force at that predetermined distance. Preferably, that predetermined number is equal to four.

Figure 5:
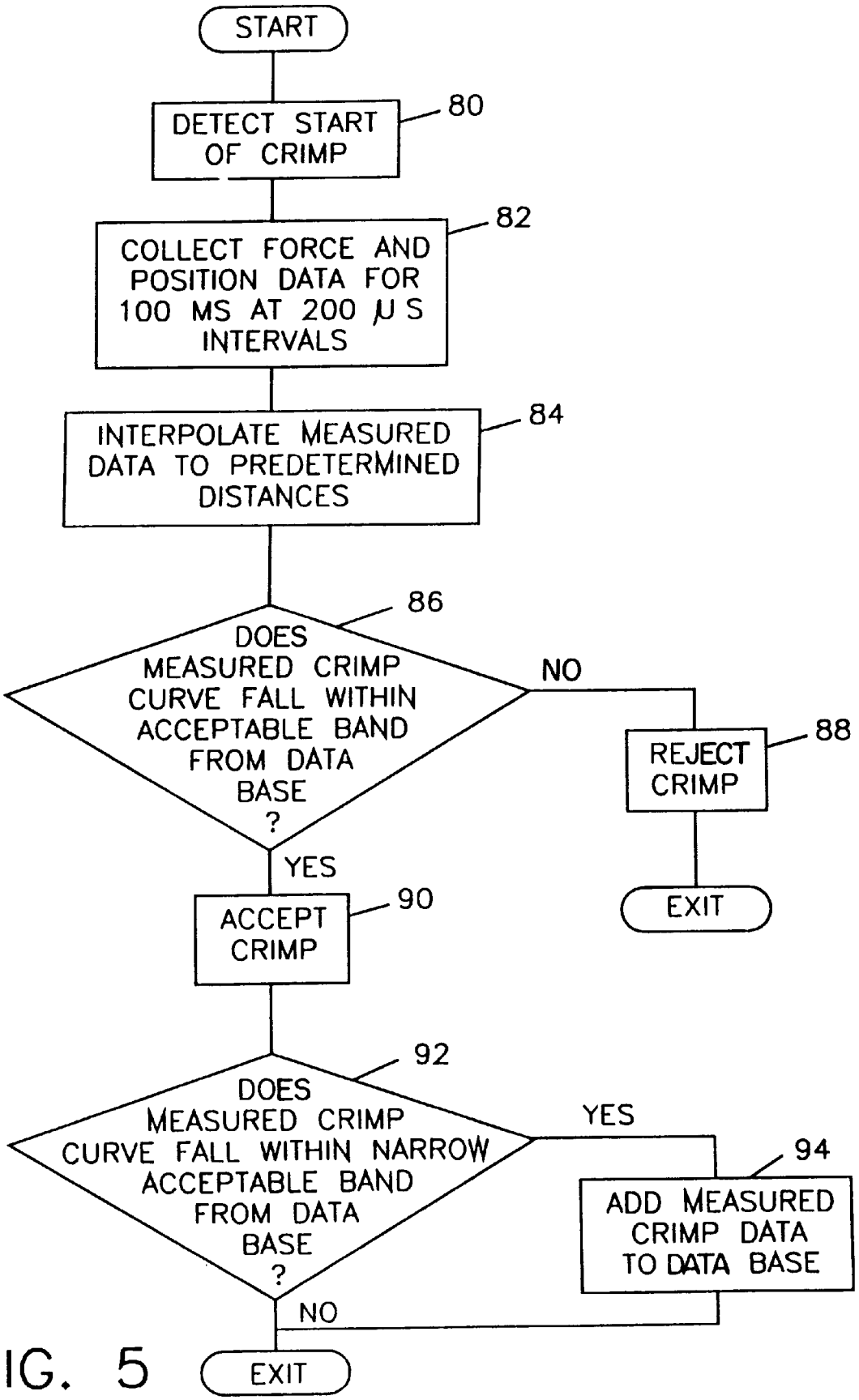
FIG. 5 is a flow chart illustrating the method of this invention.

FIG. 5 illustrates the steps in performing the inventive method. Thus, upon starting the process, the start of a crimp must be detected, as indicated by the box 80. As previously described, such detection is effected by monitoring the signals on the leads 42. Next, force and position data received over the leads 26, 42 is collected at two hundred microsecond intervals for one hundred milliseconds, as indicated by the box 82. This is more than sufficient to cover an entire crimping cycle. As indicated by the box 84, the measured data is interpolated to the set of predetermined distances. The computer 56, as indicated by the box 86, then determines whether the measured crimp curve falls within the acceptable band stored as part of the data base within the storage device 58. If not, the crimp is rejected, as indicated by the box 88. If the measured crimp curve does fall within the acceptable band, the crimp is accepted, as indicated by the box 90. Illustratively, if the force at only one of the predetermined distances is outside the band, the crimp is rejected. However, any other suitable number of "outside points" may be utilized. FIG. 4 illustrates a crimp curve 72 which falls outside the defined band 70 and which results in a rejected crimp.

To make the defined band of acceptable crimps adaptive to account for slowly changing environmental factors, if a crimp is found to be acceptable, its measured data is added to the data base. However, because data points near the edge of the allowable defined band resulting from acceptable crimps can cause the band to broaden undesirably, it is advantageous to have another tighter limit beyond which points would be excluded from the data base but not necessarily considered bad. Thus, a narrow band within the defined band is calculated. Illustratively, if the defined band is four standard deviations on either side of the average acceptable force, then the narrow band can be three standard deviations on either side of the acceptable force at each of the predetermined distances. Thus, after a crimp is accepted, the computer 56 determines whether the measured crimp curve falls within this narrow acceptable band, as indicated by the box 92. If not, the crimp is accepted and the routine is exited. If so, the measured crimp data is added to the data base, as indicated by the box 94, and then the routine is exited.

Accordingly, there has been disclosed an improved method of evaluating and controlling the quality of a crimped electrical connection. It is understood that the above-described embodiment is merely illustrative of the application of the principles of this invention. Numerous other embodiments may be devised by those skilled in the art without departing from the spirit and scope of this invention, as defined by the appended claims.

What is claimed is:

1. A method of evaluating the quality of the crimp of an electrical terminal crimped onto a wire by crimping apparatus which includes a press having a base and a ram arranged for opposing relative reciprocation, said base and said ram each carrying a mating half of a crimping die set, the method comprising the steps of:

a) placing a terminal and a wire into a crimping position within said crimping apparatus;

b) causing at least one of said base and said ram to undergo reciprocation so that said die set engages said terminal, crimps said terminal onto said wire, and disengages from said terminal;

c) during a single crimping operation of step b), making a series of paired measurements of the distance between the terminal engaging portions of said die set and the force applied to said terminal by said die set;

d) providing a data base containing upper and lower force values for a set of predetermined distances so as to define a band of force measurements within which lie the force measurements of an acceptable crimp;

e) evaluating the series of paired measurements with respect to the defined band; and f) rejecting a crimp if a predetermined number of its series of paired measurements fall outside said defined band.

2. The method according to claim 1 wherein the predetermined number for rejection in step f) is equal to one.

3. The method according to claim 1 wherein step c) is performed at a plurality of equally spaced time intervals to generate said series of paired measurements.

4. The method according to claim 1 wherein the data base of step d) is generated by taking a series of paired measurements from a sample set of a plurality of acceptable crimps.

5. The method according to claim 4 wherein the defined band of step d) is calculated by the steps of:

d1) interpolating the series of force measurements for each of said plurality of acceptable crimps to obtain a plurality of acceptable forces at each of said predetermined distances;

d2) calculating an average acceptable force at each of said predetermined distances from the plurality of acceptable forces;

d3) calculating a standard deviation at each of said predetermined distances from the plurality of acceptable forces; and d4) defining the upper and lower force values for each of said predetermined distances by adding and subtracting, respectively, a first predetermined number of standard deviations to the average acceptable force for that predetermined distance.

6. The method according to claim 5 the first predetermined number of standard deviations in step d4) is equal to four.

7. The method according to claim 5 further including the step of:

g) modifying the data base of step d) by including measurements taken on an acceptable crimp.

8. The method according to claim 7 wherein the step g) of modifying the data base includes the steps of:

g1) determining whether the measurements taken on an acceptable crimp fall within a narrow band within said defined band; and g2) including the measurements for that crimp if they lie within said narrow band.

9. The method according to claim 8 wherein said narrow band is defined by adding and subtracting a second predetermined number of standard deviations to the average acceptable force at each predetermined distance, the second predetermined number of standard deviations being less than the first predetermined number of standard deviations.

10. The method according to claim 9 wherein the first predetermined number of standard deviations is equal to four and the second predetermined number of standard deviations is equal to three.

* * * * *